US010933424B1

(12) United States Patent
Zebroski et al.

(10) Patent No.: US 10,933,424 B1
(45) Date of Patent: Mar. 2, 2021

(54) GRINDING ROLL IMPROVEMENTS

(71) Applicant: PEARSON INCORPORATED, Sioux Falls, SD (US)

(72) Inventors: Lucas Zebroski, Tea, SD (US); Roy Olson, Sioux Falls, SD (US); Robert Sandnes, Canton, SD (US); Alex Pearson, Sioux Falls, SD (US); Joshua Tracy, Harrisburg, SD (US)

(73) Assignee: Pearson Incorporated, Sioux Falls, SD (US)

( * ) Notice: Subject to any disclaimer, the term of this patent is extended or adjusted under 35 U.S.C. 154(b) by 0 days.

(21) Appl. No.: 16/710,492

(22) Filed: Dec. 11, 2019

(51) Int. Cl.
*B02C 4/30* (2006.01)
*B02C 4/08* (2006.01)

(52) U.S. Cl.
CPC . *B02C 4/30* (2013.01); *B02C 4/08* (2013.01)

(58) Field of Classification Search
CPC ..... B02C 4/30; B02C 4/08
USPC ..... 241/295
See application file for complete search history.

(56) References Cited

U.S. PATENT DOCUMENTS

| | | | | |
|---|---|---|---|---|
| 254,974 | A | 3/1882 | Hollingsworth | |
| 288,743 | A | 11/1883 | Swingle | |
| 417,836 | A | 12/1889 | Ponsar | |
| 454,950 | A | 6/1891 | Sewell | |
| 473,957 | A | 5/1892 | Pollock | |
| 621,744 | A | 3/1899 | Bowden | |
| 664,836 | A | 1/1901 | Davidson | |
| 738,166 | A | 11/1903 | Krusemark | |
| 1,390,693 | A * | 9/1921 | Garcia Fernandez | .. C13B 10/06 241/293 |

(Continued)

FOREIGN PATENT DOCUMENTS

| | | |
|---|---|---|
| CA | 2124250 | 11/1995 |
| CA | 2665876 | 11/2010 |

(Continued)

OTHER PUBLICATIONS

Charles Stark and Julie Kalivoda, "Evaluating Particle Size of Feedstuffs", publication, Nov. 2016, 4 pages, K-State Research and Extension, Kansas State University Agricultural Experiment Station and Cooperative Extension Services, Manhattan, Kansas.

(Continued)

*Primary Examiner* — Faye Francis
(74) *Attorney, Agent, or Firm* — Jeffrey A. Proehl; Woods, Fuller, Shultz & Smith, PC

(57) ABSTRACT

A grinding apparatus may include a frame and a pair of rolls each having a circumferential surface and being rotatably mounted on the frame, and a plurality of teeth located on the circumferential surface. In embodiments, at least one roll comprises a roll body structure rotatably mounted on the frame and a roll cover structure forming the circumferential surface, and the roll cover structure may be at least partially removable from the roll body structure to permit replacement of at least a portion of the circumferential surface without requiring removal of the roll body structure from the frame. In embodiments, the teeth on one roll may include an upper cap portion formed of a relatively harder material and a lower base portion formed of a relatively softer material. In embodiments, the teeth on one roll have a coating of a relatively harder material than a relatively softer base material forming the tooth.

18 Claims, 15 Drawing Sheets

(56) References Cited

U.S. PATENT DOCUMENTS 1,403,262 A 1/1922 Magill
1,466,508 A 8/1923 Lake
1,568,267 A 1/1926 Carter
1,611,675 A 12/1926 Prestemon
1,678,134 A 7/1928 Cromer
2,053,038 A 9/1936 MacKenzie
2,118,010 A 5/1938 Hazle, Jr.
2,202,892 A * 6/1940 Berry ..... B02C 4/06 241/236
2,608,973 A 9/1952 Coons
2,887,276 A * 5/1959 Minarik ..... B24D 5/10 241/67
3,226,041 A 12/1965 Graumann
3,261,152 A 7/1966 Johnson
3,304,355 A 2/1967 Pobst, Jr.
3,321,079 A 5/1967 Sackett
3,362,649 A 1/1968 Odden
3,518,818 A 7/1970 Porter
3,651,625 A 3/1972 Redford
3,683,559 A 8/1972 Kalwaites
3,752,315 A 8/1973 Hubach
3,862,721 A * 1/1975 Flair ..... B02C 18/142 241/236
4,083,501 A 4/1978 Ryan
4,165,280 A 8/1979 Holley
4,177,900 A 12/1979 Kluthe
4,200,242 A 4/1980 Jeda
4,202,629 A 5/1980 Jakobs
4,213,855 A 7/1980 Vonbennigsen-MacKiewicz
4,361,476 A 11/1982 Brewer
4,387,552 A 6/1983 Lancaster
4,442,876 A 4/1984 Koike
4,468,265 A 8/1984 MacLaughlin
4,499,712 A 2/1985 Klinner
4,561,156 A * 12/1985 Sun ..... C13B 10/06 100/121
4,572,216 A 2/1986 Josuttis
4,587,799 A 5/1986 Thomas
4,608,156 A 8/1986 Reddish
4,609,158 A 9/1986 Wilson
4,617,709 A * 10/1986 Gundlach ..... B02C 4/305 241/293
4,645,484 A 2/1987 Niske
4,720,207 A * 1/1988 Salani ..... B28D 1/186 172/123
4,786,001 A 11/1988 Ephraim
4,843,806 A 7/1989 Klinner
4,848,681 A 7/1989 Erikkson
4,856,428 A * 8/1989 Green ..... B41F 13/18 101/475
4,862,570 A 9/1989 Bald
4,886,218 A * 12/1989 Bradley ..... B02C 2/005 241/294
4,896,486 A 1/1990 Lundahl
4,941,290 A 7/1990 Holyoke
4,951,451 A 8/1990 Klinner
1,965,993 A 10/1990 Butler
4,986,997 A 1/1991 Posner
5,000,392 A * 3/1991 Kastingschafer ..... B02C 4/305 241/294
5,036,653 A 8/1991 Klinner
5,044,115 A 9/1991 Richardson
5,044,147 A 9/1991 Klinner
5,052,088 A 10/1991 Hagewood
5,100,062 A 3/1992 Baltensperger
5,115,984 A 5/1992 Satake
5,185,991 A 2/1993 Klinner
5,192,028 A 3/1993 Curran
5,201,470 A 4/1993 Baltensperger
5,247,717 A 9/1993 Smith
5,251,144 A 10/1993 Ramamurthi
5,253,816 A * 10/1993 Kastingschafer ..... B02C 4/30 100/176
5,315,789 A 5/1994 Takashi
5,366,167 A 11/1994 McCarthy
5,392,998 A 2/1995 Suessegger
5,419,107 A 5/1995 Shelbourne
5,501,629 A 3/1996 Kawana
5,523,701 A 6/1996 Smith
5,533,371 A 7/1996 Frischknecht
5,536,073 A * 7/1996 Sulosky ..... E02F 9/2866 299/39.8
5,597,125 A 1/1997 Bouldin
5,622,323 A 4/1997 Krueger
5,632,135 A 5/1997 Baker, IV
5,663,512 A 9/1997 Schader
5,717,209 A 2/1998 Bigman
5,745,947 A 5/1998 Liu
5,846,129 A 12/1998 Dragt
5,850,656 A 12/1998 Smith
5,974,772 A 11/1999 Chuksin
6,016,626 A 1/2000 Auer
6,036,127 A 3/2000 Moller
6,142,923 A * 11/2000 Bakoledis ..... B31B 50/00 492/30
6,176,683 B1 1/2001 Yang
6,199,777 B1 3/2001 Satake
6,258,308 B1 7/2001 Brady
6,293,478 B1 9/2001 Livrieri
6,315,659 B1 11/2001 Shelbourne
6,338,236 B1 1/2002 Rodriguez
6,365,416 B1 4/2002 Elsohly
6,372,281 B1 4/2002 Metzger
6,375,104 B1 4/2002 Hruska
6,443,376 B1 9/2002 Huang
6,517,016 B1 2/2003 Feige
6,589,598 B2 7/2003 Ochiai
6,730,519 B2 5/2004 Elsohly
6,886,763 B2 5/2005 Lepage
6,990,431 B2 1/2006 Beaudoin
7,006,953 B2 2/2006 Takemura
7,083,544 B2 8/2006 Goransson
7,170,251 B2 1/2007 Huang
7,183,735 B2 2/2007 Heinemann
7,206,719 B2 4/2007 Lindsay
7,285,180 B2 * 10/2007 Sicley ..... D21D 1/40 162/357
7,381,017 B2 6/2008 Wang
7,419,694 B2 9/2008 Korolchuk
7,425,344 B2 9/2008 Korolchuk
7,540,697 B2 1/2009 Wang
7,568,641 B2 8/2009 Dreimann
7,592,468 B2 9/2009 Goodwin
7,756,678 B2 7/2010 Bonissone
7,757,980 B2 7/2010 Oare
7,832,241 B2 11/2010 Mantovan
8,016,220 B2 9/2011 Melo
8,144,005 B2 3/2012 Hu
8,162,243 B2 4/2012 Wenthe
8,206,061 B1 6/2012 Hansen
8,211,341 B2 7/2012 Lustiger
8,292,207 B2 10/2012 Fard
8,343,553 B2 1/2013 Hospodor
8,485,052 B2 7/2013 Gebhart
8,690,087 B2 4/2014 Holl
8,734,143 B2 5/2014 Morris
8,806,844 B2 8/2014 Miller
8,842,267 B2 9/2014 Heine
9,066,910 B2 6/2015 Rosenblatt
9,104,650 B2 8/2015 Hosek
9,510,507 B1 12/2016 Abbott
9,592,457 B2 3/2017 Dabao
9,604,226 B2 3/2017 Storm
9,649,349 B1 5/2017 Tucker
9,651,467 B2 5/2017 Deguchi
9,694,040 B2 7/2017 Scialdone
9,723,786 B2 8/2017 Brummelhuis
9,744,200 B1 8/2017 Tucker
9,744,737 B2 * 8/2017 Habermann ..... B30B 11/165
9,788,770 B1 10/2017 Belthangady
9,795,338 B2 10/2017 Kang
9,797,822 B2 10/2017 Little, III
9,801,956 B2 10/2017 Kularatne

(56) References Cited

U.S. PATENT DOCUMENTS

| | | | | |
|---|---|---|---|---|
| 9,803,063 | B2 | 10/2017 | Reddy | |
| 9,804,092 | B2 | 10/2017 | Zeng | |
| 9,808,538 | B2 | 11/2017 | Kularatne | |
| 9,919,315 | B2 | 3/2018 | Pearson | |
| 9,959,514 | B2 | 5/2018 | Phan | |
| 9,974,821 | B2 | 5/2018 | Kennedy | |
| 10,143,706 | B2 | 12/2018 | Kotra | |
| 10,322,487 | B1 | 6/2019 | Hansen | |
| 10,399,082 | B1 | 9/2019 | Pearson | |
| 10,524,423 | B1 | 1/2020 | Olson | |
| 2001/0006013 | A1 | 7/2001 | Nobauer | |
| 2002/0022899 | A1 | 2/2002 | Dehy | |
| 2002/0168911 | A1 | 11/2002 | Tonner | |
| 2002/0175055 | A1 | 11/2002 | Ryde | |
| 2003/0017426 | A1 | 1/2003 | Schmidt | |
| 2004/0096585 | A1 | 5/2004 | Bonnebat | |
| 2005/0188668 | A1 | 9/2005 | Geraghty | |
| 2006/0073258 | A1 | 4/2006 | Korolchuk | |
| 2006/0207862 | A1 | 9/2006 | Costanzo | |
| 2006/0231021 | A1 | 10/2006 | Friske | |
| 2007/0170291 | A1 | 7/2007 | Naganawa | |
| 2007/0209347 | A1 | 9/2007 | Malmros | |
| 2007/0294121 | A1 | 12/2007 | Galt | |
| 2008/0063330 | A1 | 3/2008 | Orlowski | |
| 2008/0167483 | A1 | 7/2008 | Whittle | |
| 2008/0203956 | A1 | 8/2008 | Cohen | |
| 2008/0275660 | A1 | 11/2008 | Bhateja | |
| 2009/0093191 | A1 | 4/2009 | Glide | |
| 2009/0295561 | A1 | 12/2009 | Hu | |
| 2010/0030926 | A1 | 2/2010 | Boussy | |
| 2010/0059609 | A1 | 3/2010 | Teeter | |
| 2010/0127217 | A1 | 5/2010 | Lightowlers | |
| 2011/0067374 | A1 | 3/2011 | James | |
| 2011/0113740 | A1 | 5/2011 | Desmarais | |
| 2011/0276828 | A1 | 11/2011 | Tamaki | |
| 2012/0005107 | A1 | 1/2012 | Lowden | |
| 2012/0046352 | A1 | 2/2012 | Hospodor | |
| 2012/0244266 | A1 | 9/2012 | Ku | |
| 2013/0087644 | A1 | 4/2013 | Ephraim | |
| 2013/0271110 | A1 | 10/2013 | Yamanaka | |
| 2013/0301375 | A1 | 11/2013 | Stephan | |
| 2014/0014748 | A1 | 1/2014 | Zeeck | |
| 2014/0048459 | A1 | 2/2014 | Hafford | |
| 2014/0145018 | A1 | 5/2014 | Niklewski | |
| 2014/0245799 | A1* | 9/2014 | Kim | C05F 17/50 71/10 |
| 2014/0252141 | A1* | 9/2014 | Weinmann | B02C 4/06 241/9 |
| 2014/0299688 | A1 | 10/2014 | Carbonini | |
| 2015/0027096 | A1 | 1/2015 | Black | |
| 2015/0028139 | A1* | 1/2015 | Bihn | B02C 4/06 241/7 |
| 2015/0129698 | A1* | 5/2015 | Olson | B02C 4/32 241/230 |
| 2015/0156967 | A1 | 6/2015 | Steenland | |
| 2015/0211971 | A1 | 7/2015 | Little, III | |
| 2015/0217295 | A1* | 8/2015 | Niklewski | B30B 11/165 241/294 |
| 2015/0224509 | A1 | 8/2015 | Serrano | |
| 2015/0300800 | A1 | 10/2015 | Van Valkenburgh | |
| 2015/0324759 | A1 | 11/2015 | Bansal | |
| 2015/0346717 | A1 | 12/2015 | Hosek | |
| 2016/0100524 | A1 | 4/2016 | Young | |
| 2016/0120123 | A1 | 5/2016 | Brummelhuis | |
| 2016/0245588 | A1 | 8/2016 | Baugh | |
| 2016/0263580 | A1* | 9/2016 | Rhea | B02C 4/08 |
| 2016/0374386 | A1 | 12/2016 | Desmarais | |
| 2017/0021357 | A1* | 1/2017 | Birtch | B02C 4/305 |
| 2017/0027105 | A1 | 2/2017 | Wenger | |
| 2017/0043347 | A1* | 2/2017 | Berglund | B22F 1/0003 |
| 2017/0080466 | A1 | 3/2017 | Godwin | |
| 2017/0131194 | A1 | 5/2017 | Little, III | |
| 2017/0136468 | A1* | 5/2017 | Barber | B02C 13/06 |
| 2017/0333257 | A1 | 11/2017 | Schmitz | |
| 2017/0333809 | A1 | 11/2017 | Lopa | |
| 2018/0035610 | A1 | 2/2018 | Wieker | |
| 2018/0126578 | A1 | 5/2018 | Raichart | |
| 2018/0199511 | A1* | 7/2018 | Horning, Jr. | B02C 4/08 |
| 2018/0213722 | A1 | 8/2018 | Pratt | |
| 2019/0124840 | A1 | 5/2019 | Bates | |
| 2019/0276420 | A1 | 9/2019 | Cho | |

FOREIGN PATENT DOCUMENTS

| | | |
|---|---|---|
| CA | 3012914 | 10/2018 |
| CN | 201702458 | 1/2011 |
| CN | 201720507 | 1/2011 |
| CN | 201799709 | 4/2011 |
| CN | 101401506 | 6/2012 |
| CN | 202873360 | 4/2013 |
| CN | 202921355 | 5/2013 |
| CN | 103430692 | 12/2013 |
| CN | 103497823 | 1/2014 |
| CN | 104194920 | 12/2014 |
| CN | 204907202 | 12/2015 |
| CN | 205030140 | 2/2016 |
| CN | 105594370 | 5/2016 |
| CN | 206690229 | 12/2017 |
| CN | 108064545 | 5/2018 |
| CN | 108076804 | 5/2018 |
| CN | 207385669 | 5/2018 |
| CN | 108624394 | 10/2018 |
| CN | 108718676 | 11/2018 |
| CN | 108811715 | 11/2018 |
| CN | 108633454 | 12/2018 |
| CN | 108941548 | 12/2018 |
| CN | 109363026 | 2/2019 |
| CN | 109576578 | 4/2019 |
| DE | 2737115 | 3/1979 |
| DE | 2807634 | 8/1979 |
| DE | 3717610 | 3/1988 |
| DE | 19627137 | 1/1998 |
| DE | 102005055373 | 5/2007 |
| EP | 0383410 | 8/1990 |
| EP | 1195668 | 9/2002 |
| EP | 1757181 | 2/2007 |
| EP | 2556740 | 2/2013 |
| FR | 2885009 | 11/2006 |
| GB | 736092 | 8/1955 |
| GB | 973177 | 10/1964 |
| JP | 2010201440 | 9/2010 |
| RU | 2119737 | 10/1998 |
| WO | 9419970 | 9/1994 |
| WO | 0000012 | 1/2000 |
| WO | 2005119089 | 12/2005 |
| WO | 2007066847 | 6/2007 |
| WO | 2007133098 | 11/2007 |
| WO | 2009128711 | 10/2009 |
| WO | 2010082322 | 7/2010 |
| WO | 2010130035 | 11/2010 |
| WO | 2013160576 | 10/2013 |
| WO | 2017051398 | 3/2017 |
| WO | 2018014135 | 1/2018 |
| WO | 2019041017 | 3/2019 |
| WO | 2019119153 | 6/2019 |
| WO | 2019157783 | 8/2019 |

OTHER PUBLICATIONS

Revolutionary Hemp Harvester, "Introducing the Revolutionary Hemp Harvester", 11 pages, https://revolutionaryhempharvester.com, download date Nov. 21, 2019.

RHHE, LLC, "Revolutionary Hemp Harvester", Equipment Story, 2 pages, https://revolutionaryhempharvester.com, download date Nov. 15, 2019.

RHHE, LLC, "Revolutionary Hemp Harvester", Inventor Story, 2 pages, https://revolutionaryhempharvester.com, download date Nov. 15, 2019.

Chris Crowell, "Are you brewer enough to face the T-REX by Ziemann at CBC 2016?", Apr. 25, 2016, webpage https://www.

(56) References Cited

OTHER PUBLICATIONS craftbrewingbusiness.com/equipment-systems/, download date Dec. 10, 2019, 8 pages, CBB Media, LLC.

* cited by examiner

GRINDING ROLL IMPROVEMENTS

BACKGROUND

Field

The present disclosure relates to grinding rolls and more particularly pertains to a new grinding roll improvements for maintaining the sharpness of teeth on the grinding roll for a longer period and/or facilitating replacement of worn or damaged teeth on the roll.

SUMMARY

In one aspect, the present disclosure relates to a grinding apparatus comprising a frame and a pair of rolls each having a circumferential surface and being rotatably mounted on the frame to define a gap between the circumferential surfaces of the rolls, with a plurality of teeth being located on the circumferential surface of the roll. In some embodiments, at least one of the rolls comprises a roll assembly for rotating about a central rotation axis, with the roll assembly being elongated with opposite ends and end portions located adjacent to the respective ends, and the end portions of the roll assembly being rotatably mounted on the frame. The roll assembly may comprise a roll body structure forming the end portions of the roll assembly rotatably mounted on the frame, and a roll cover structure forming the circumferential surface of the at least one roll. The roll cover structure may be at least partially removably mounted on the roll body structure to permit replacement of at least a portion of the circumferential surface without requiring removal of the roll body structure of the roll assembly from the frame. In some embodiments, the teeth on at least one of the rolls each include an upper cap portion and a lower base portion, with the upper cap portion forming a peak ridge of the tooth and the lower base portion being positioned between valleys formed between the teeth on the at least one roll. The upper cap portion may be formed of a relatively harder material and the lower base portion may be formed of a relatively softer material. In some embodiments, the teeth on at least one of the rolls each have a coating formed thereon, with the coating being formed of a relatively harder material than a relatively softer base material forming the tooth.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

With reference now to the drawings, and in particular to FIGS. 1 through 21 thereof, new grinding roll improvements embodying the principles and concepts of the disclosed subject matter will be described.

In one aspect, the disclosure relates to a system 10 for grinding or milling material into smaller pieces, and may receive particles of one size (or range of sizes) and reduce the size of the pieces into smaller particles.

The applicants have recognized that reducing wear, or the rate at which wear occurs, on grinding or milling rolls has many advantages, including longer service periods between replacement and higher quality grinding output at a faster rate during the period that the roll is used. Corrugations, or teeth, on the surface of the roll not only cut the material passing over the teeth, but also function to pull the material through the "nip" or gap between two grinding rolls while cutting the material. Teeth of the roll with less surface area on the tip of the tooth are considered to be "sharper" than teeth with more surface area at the tip, and wear on the roll causes the surface of the tip to gradually increase, reducing the sharpness of the teeth on the roll and the effectiveness of the ability of the teeth to pull the material into the gap between the rolls and cut or shear the material. As a result, the size reduction of the particles being ground becomes less uniform, and ultimately may tend to compress the particles more than cut the particles, resulting in "mashing" or "flaking" of the material which is less desirable as a product of the apparatus.

The applicants have also recognized that the maintenance needed to service rolls which have dulled teeth requires that the grinding apparatus be taken out of operation while the rolls are changed out with rolls with sharpened teeth. Thus, the cost of replacing the rolls with new rolls or re-sharpened rolls is increased by the cost of the loss of service of the grinding apparatus while the changeout is accomplished, which often requires disassembly of a significant portion of the apparatus to release the rolls. Moreover, the disassembly process itself may trigger premature failure of other components after reassembly of the apparatus.

Figure 1:
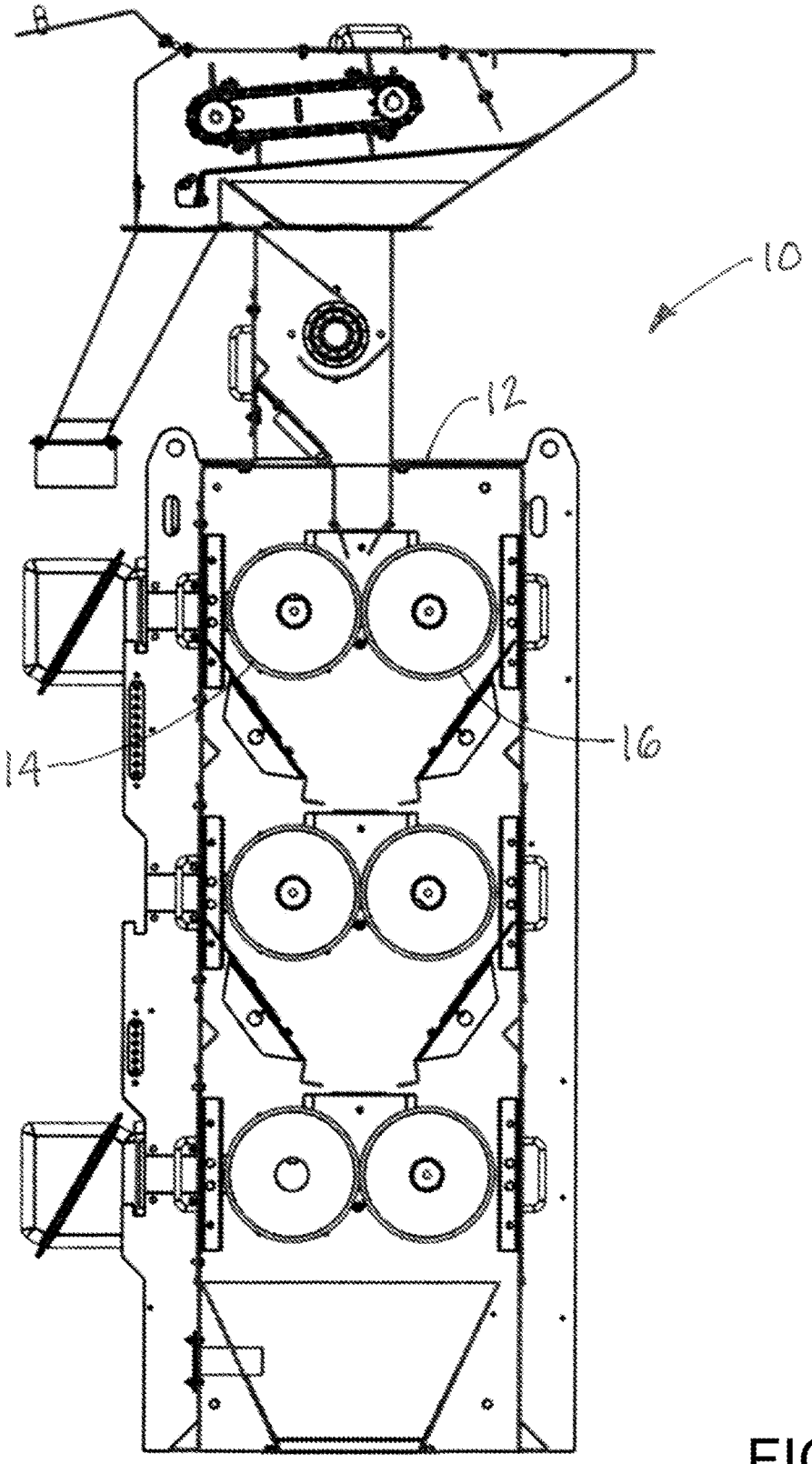
FIG. 1 is a schematic side sectional view of a grinding system useful for incorporating grinding rolls with improvements according to the present disclosure.
Figure 2:
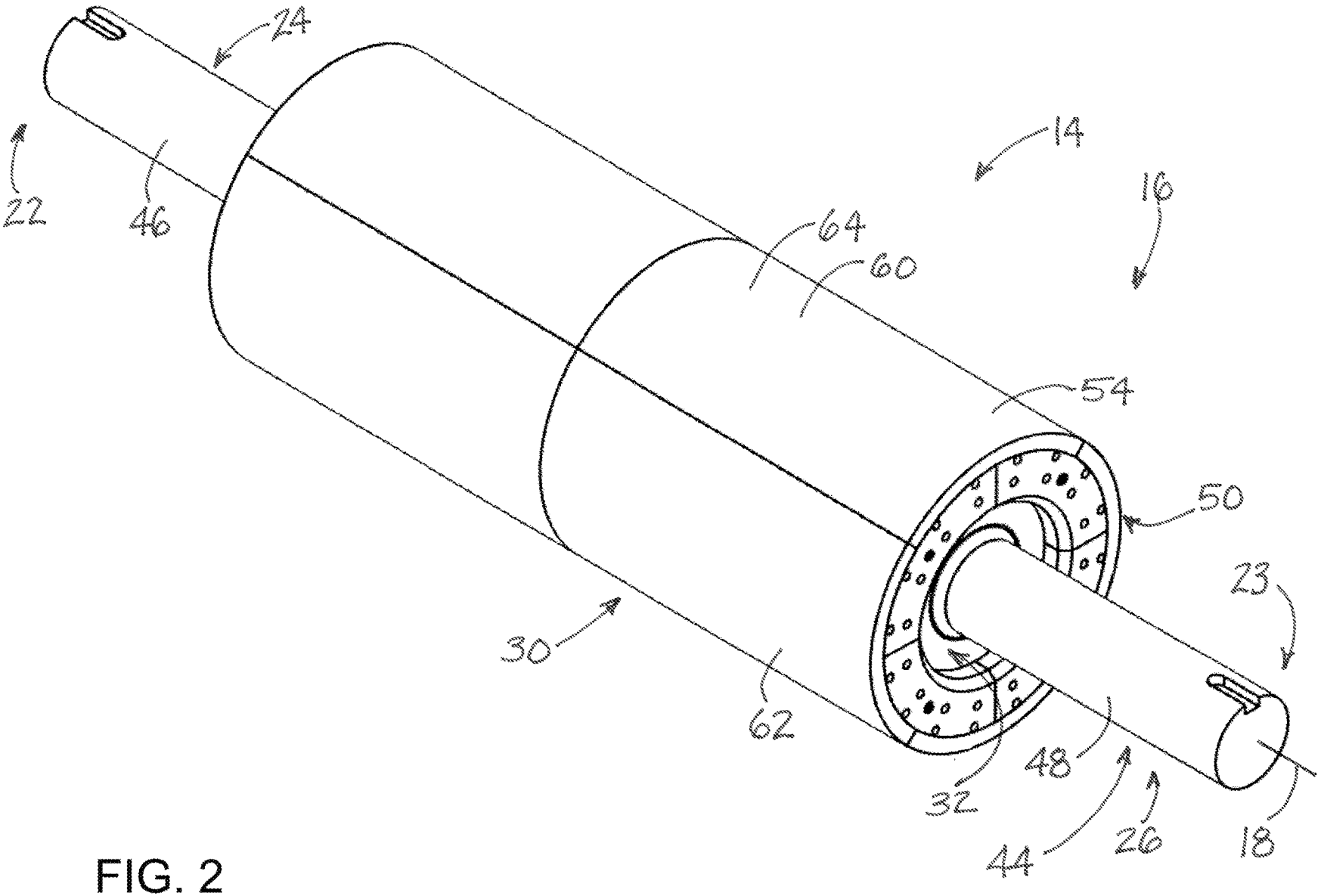
FIG. 2 is a schematic perspective view of a roll assembly of a grinding roll, according to an illustrative embodiment.
Figure 3:
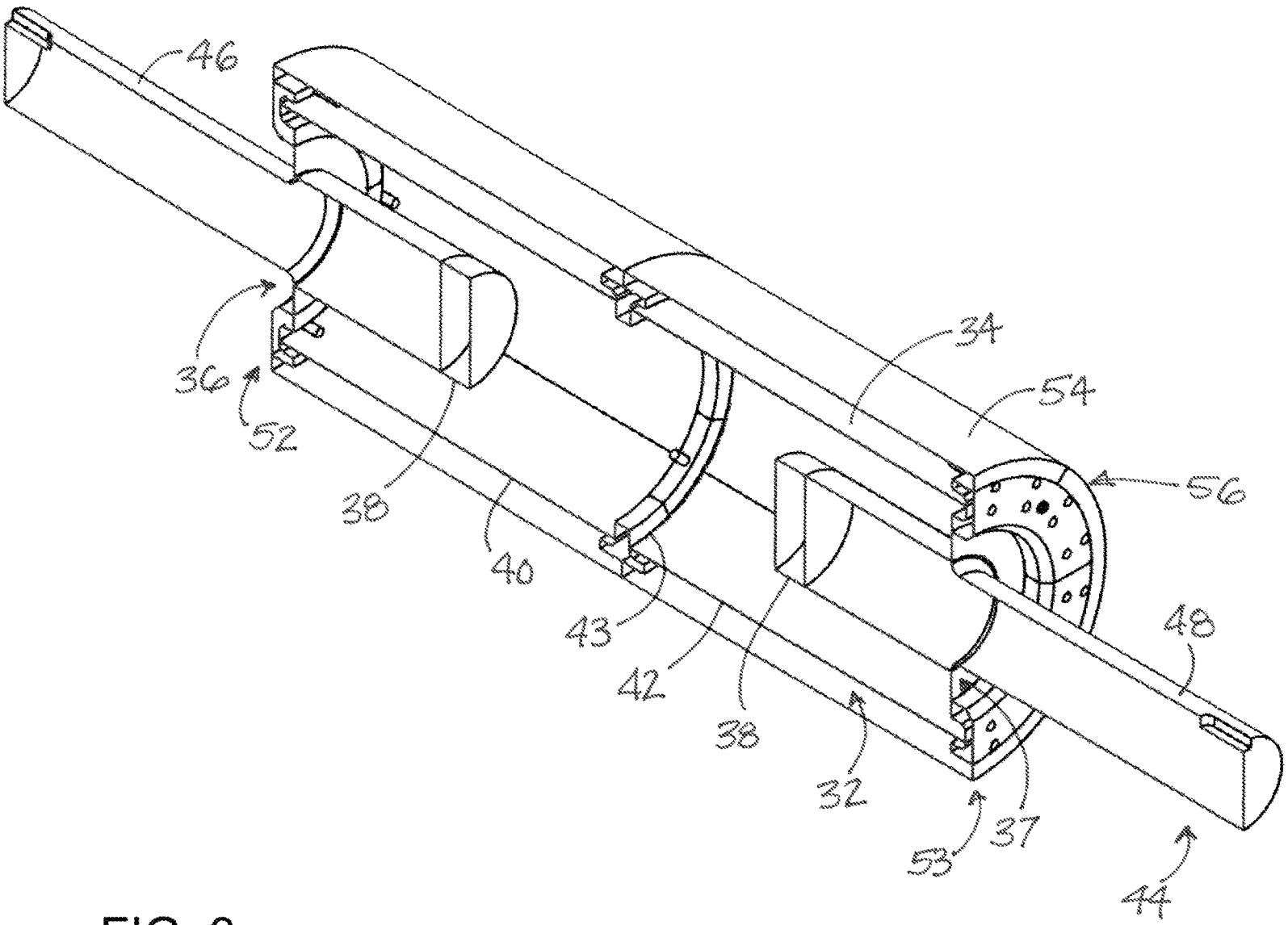
FIG. 3 is a schematic longitudinal sectional perspective view of the roll assembly of FIG. 2, according to an illustrative embodiment.
Figure 4:
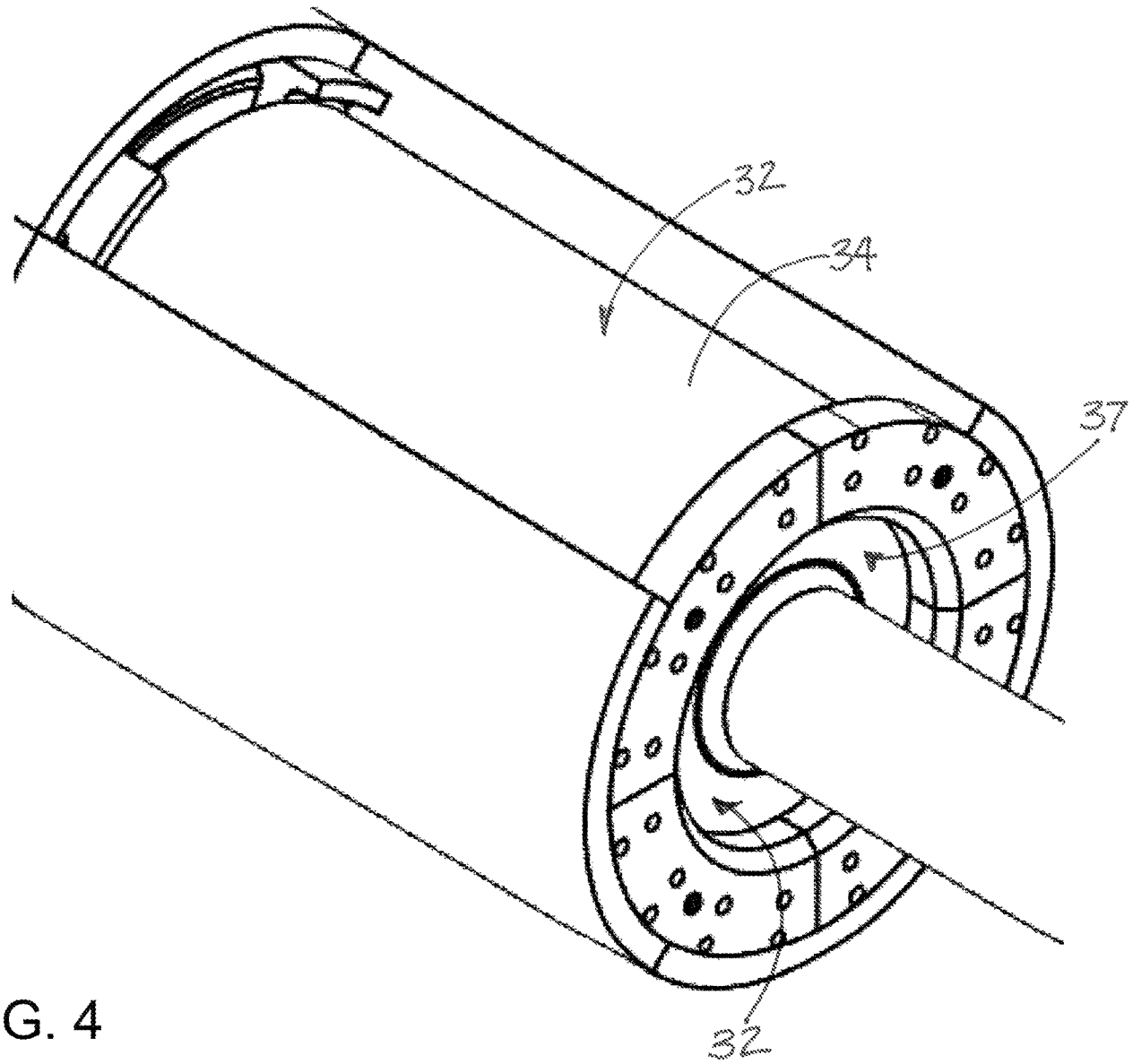
FIG. 4 is a schematic perspective view of a portion of the roll assembly of FIG. 2 with a roll cover segment of the roll cover removed to reveal underlying detail, according to an illustrative embodiment.
Figure 5:
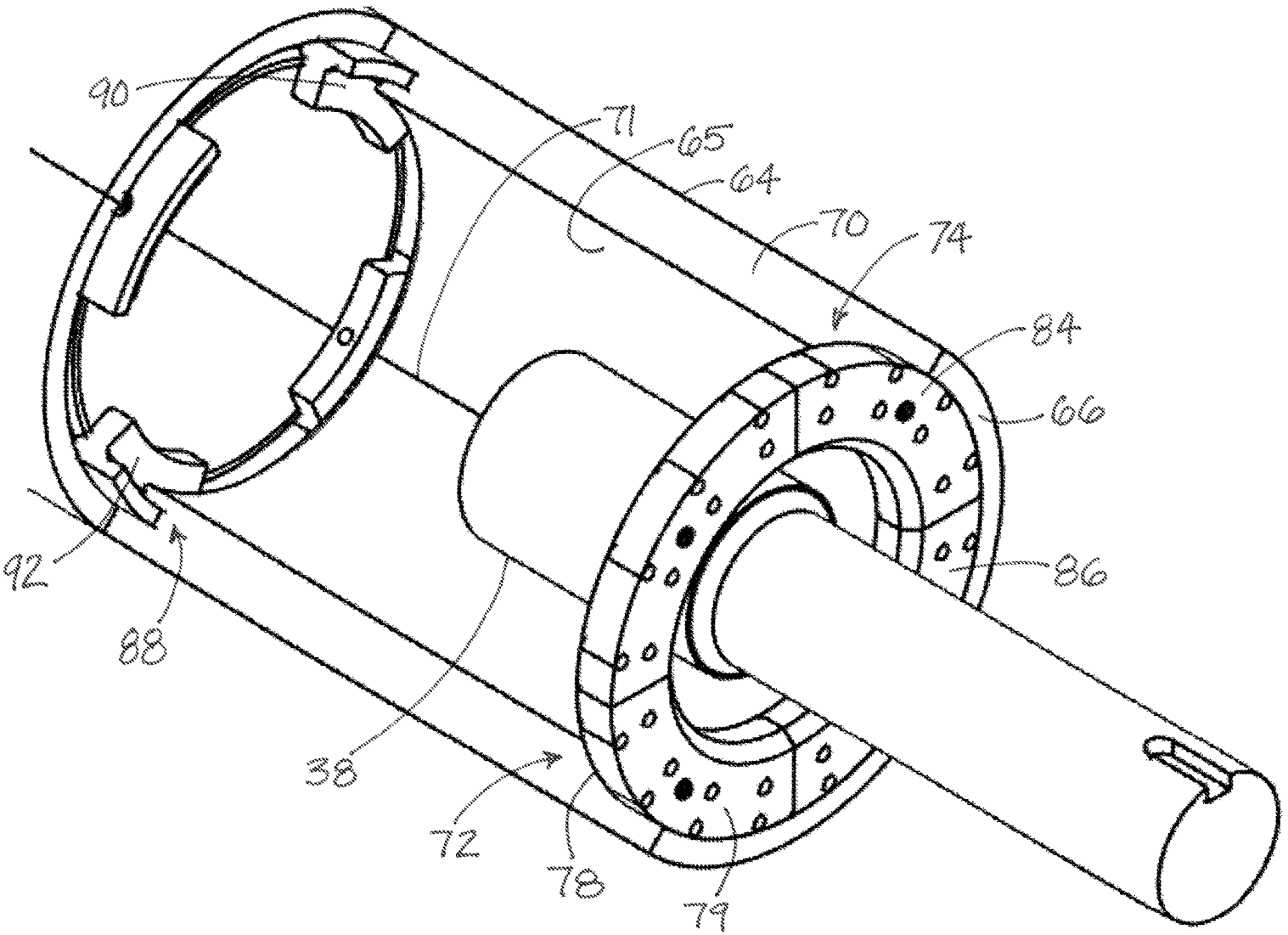
FIG. 5 is a schematic perspective view of a portion of the roll assembly of FIG. 2 with roll cover segments removed and the center core made transparent to reveal underlying detail, according to an illustrative embodiment.
Figure 6:
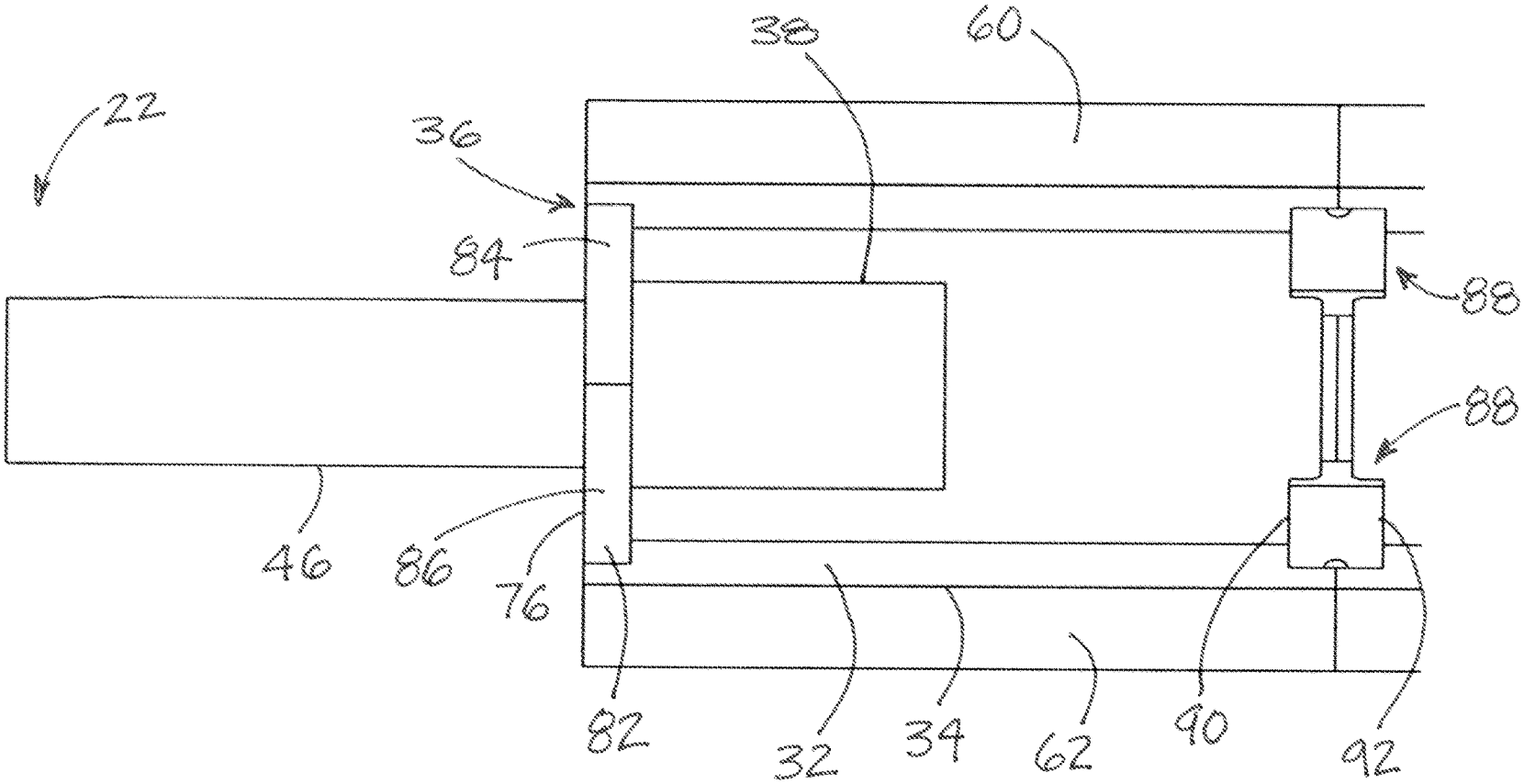
FIG. 6 is a schematic lateral sectional view of a portion of the roll assembly of FIG. 2 with roll cover segments removed and the center core made transparent to reveal underlying detail, according to an illustrative embodiment.
Figure 7:
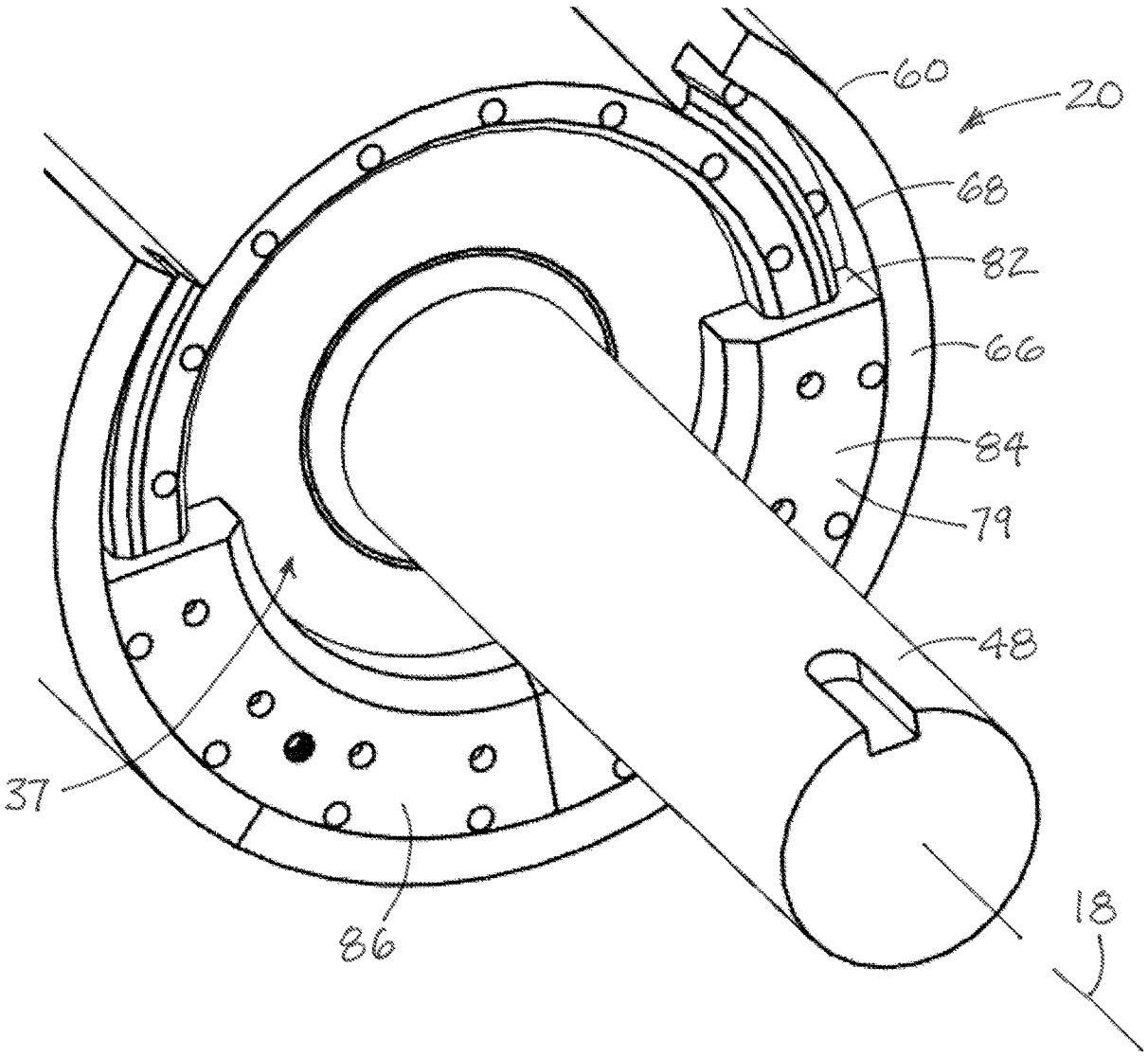
FIG. 7 is a schematic perspective view of an end portion of the roll assembly of FIG. 2 with roll cover segments and a portion of an end cap removed to reveal underlying detail, according to an illustrative embodiment.
Figure 8:
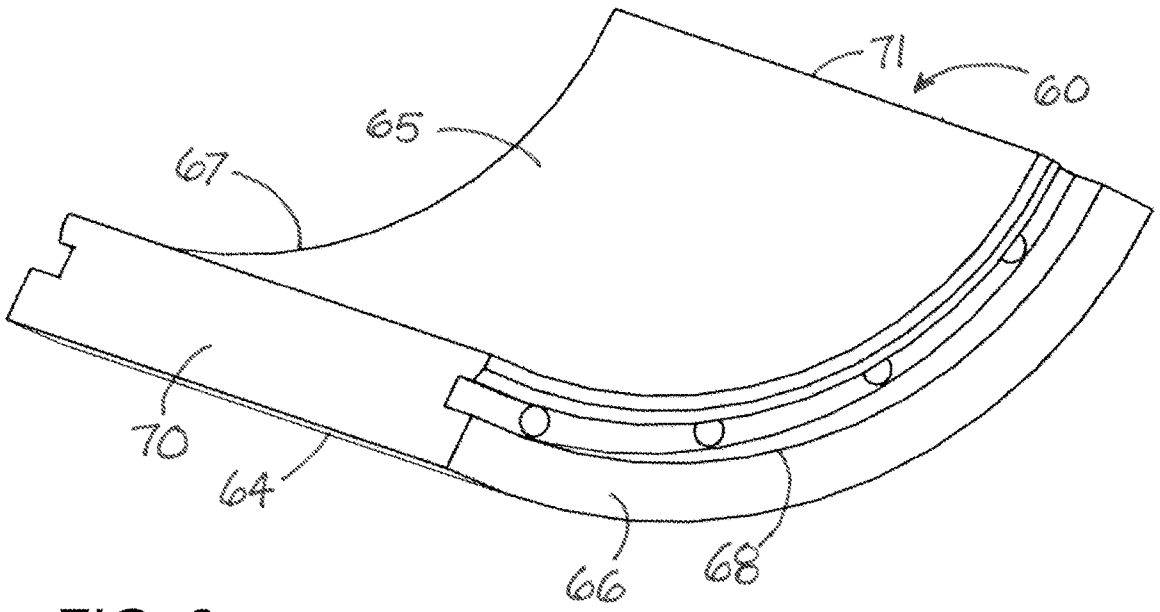
FIG. 8 is a schematic perspective view of a roll cover segment shown isolated from other elements of the roll assembly of FIG. 2, according to an illustrative embodiment.
Figure 9:
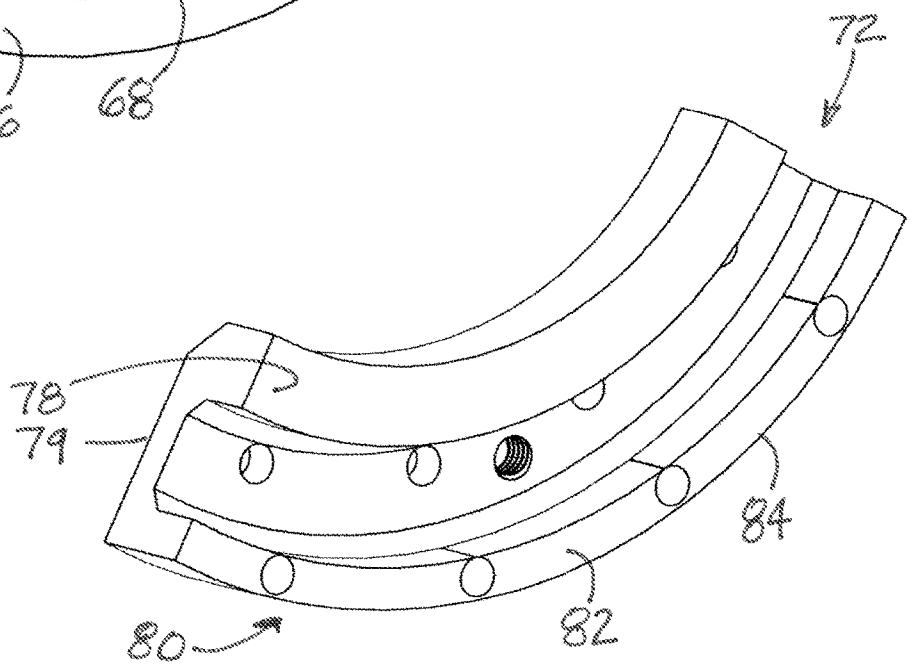
FIG. 9 is a schematic perspective view of a roll cover end cap shown isolated from other elements of the roll assembly of FIG. 2, according to an illustrative embodiment.
Figure 10:
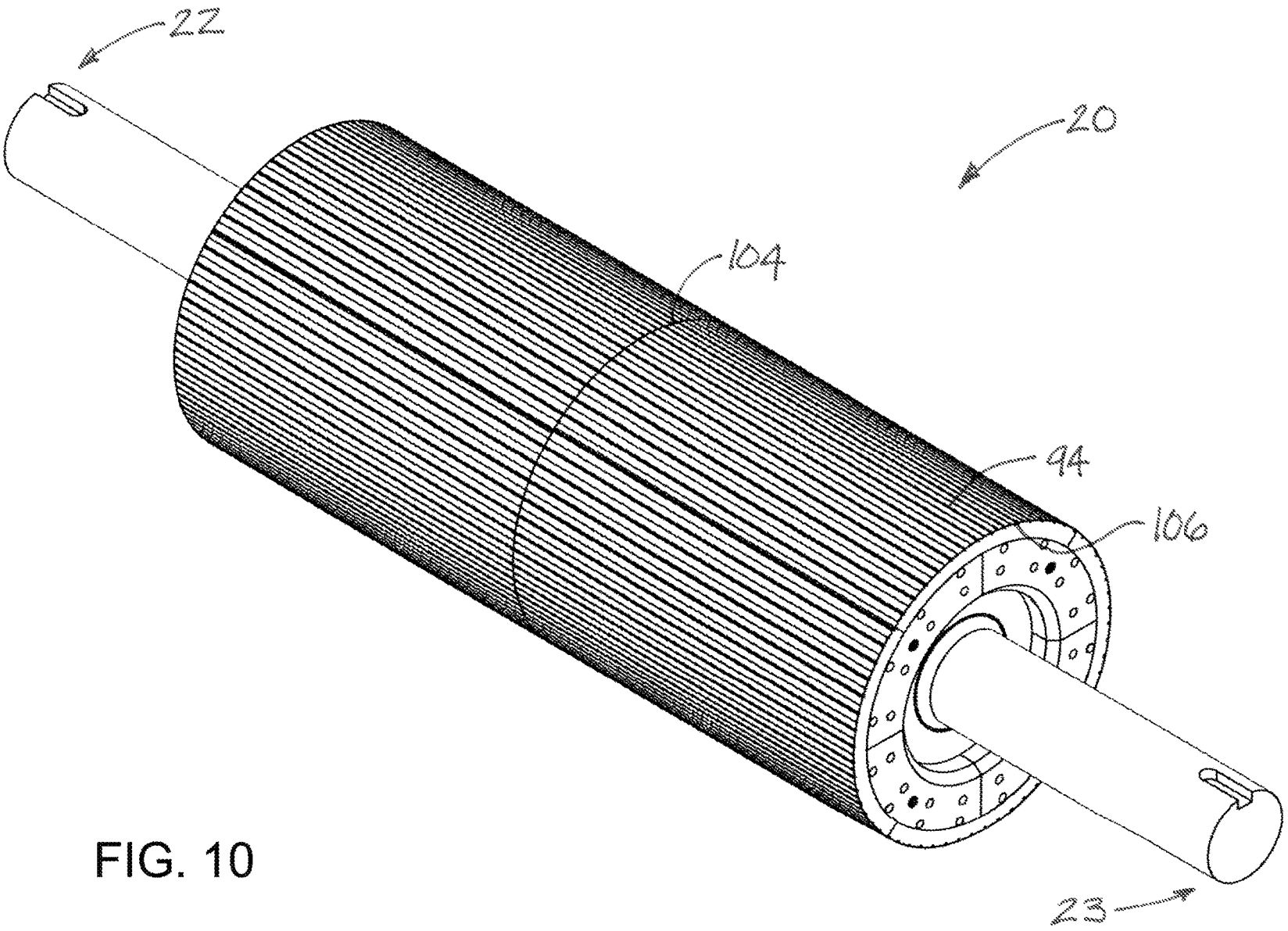
FIG. 10 is a schematic perspective view of another roll assembly of a grinding roll, according to an illustrative embodiment.
Figure 11:
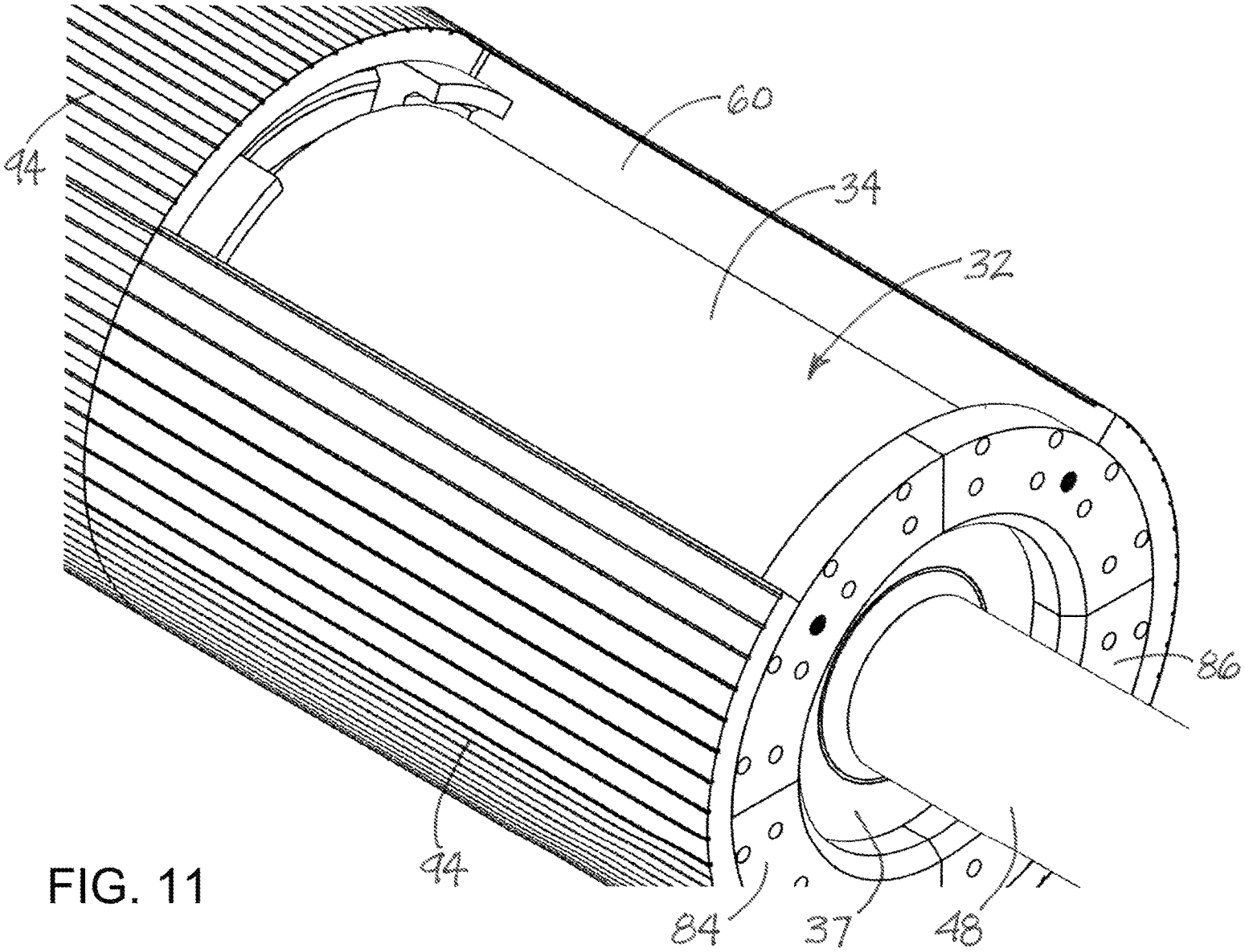
FIG. 11 is a schematic perspective view of a portion of the roll assembly of FIG. 10 with a roll cover segment of the roll cover and a plurality of tooth slats removed to reveal underlying detail, according to an illustrative embodiment.
Figure 12:
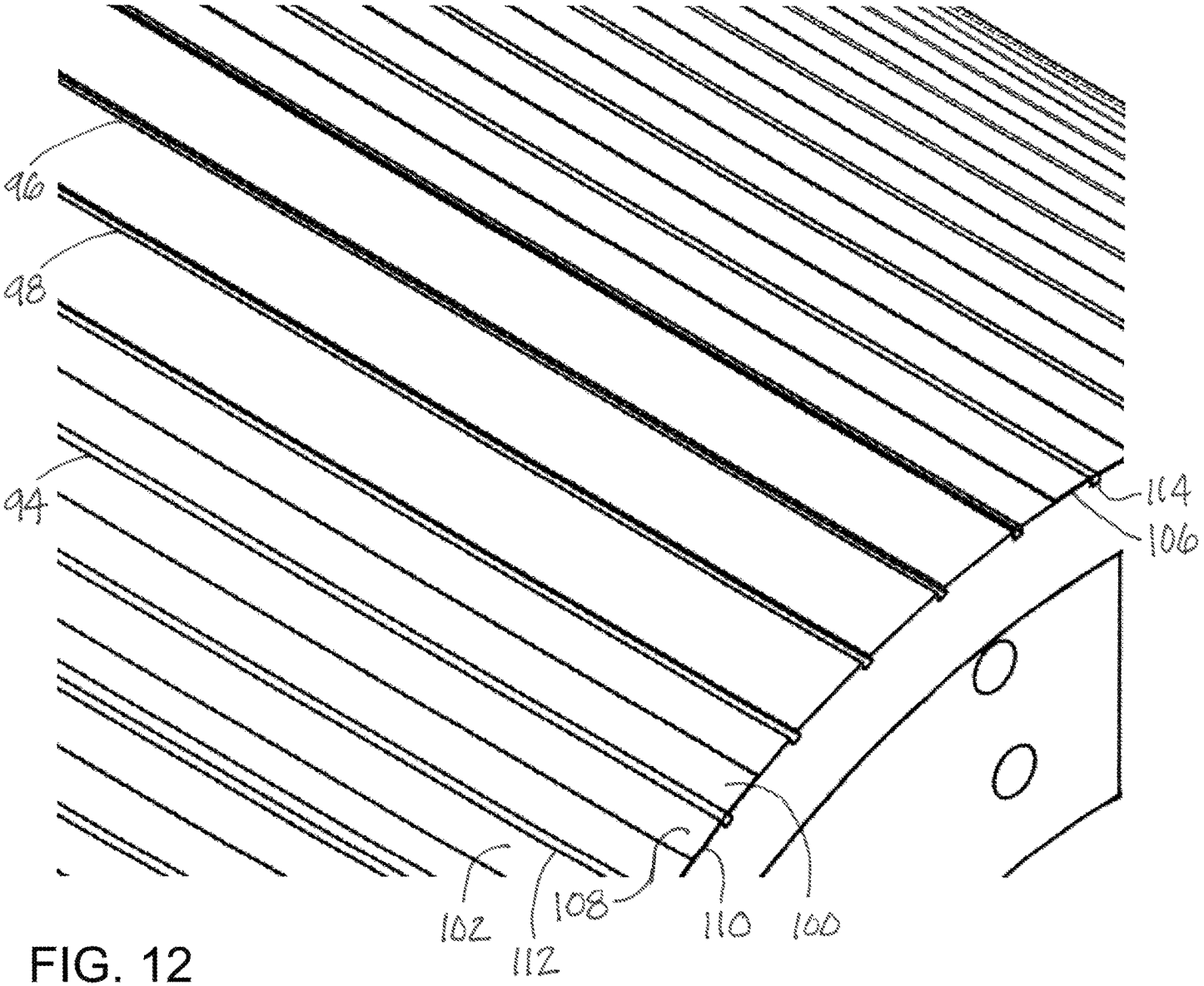
FIG. 12 is a schematic perspective view of a portion of the roll assembly of FIG. 10 with a plurality of tooth slats removed to reveal underlying detail, according to an illustrative embodiment.

In general, the system 10 such as is shown in FIG. 1 may include a supportive frame 12 and at least a pair of rolls 14, 16 which are supported on the frame in a manner that permits the rolls to rotate with respect to the frame about a respective central rotation axis 18. Material to be ground is passed through a gap or nip between the rolls 14, 16 as the material descends through the apparatus. A series of the pairs of rolls may be employed in a vertical arrangement such that material falling through the successive gaps may be progressively ground to finer and finer sizes.

Another aspect of the disclosure relates to an approach for addressing the need to periodically address a roll having teeth worn beyond the point at which the teeth effectively pull the material through the nip and cut the material into smaller pieces in a substantially uniform fashion. Such an approach may facilitate replacement and renewal of portions of the roll without requiring replacement of the entire roll with another roll when the teeth of the roll have worn beyond an acceptable level, or damage has occurred to a portion of the roll that would normally require replacement of the entire roll. These features will be described in terms of one of the rolls with the understanding that the features may be applied to both rolls of the pair, as well as multiple pairs of rolls.

In greater detail, the roll 14 may include a roll assembly 20 rotating about the central rotation axis 18 and with a number of features that may be typical for a grinding roll. The roll assembly 20 may be elongated with opposite ends 22, 23 and end portions 24, 26 located adjacent to the respective ends 22, 23. The end portions 24, 26 of the roll assembly 20 may be rotatably mounted on the frame 12.

Differentiating the roll assembly 20 from more conventional rolls, the roll assembly 20 may include a roll body structure 30 which may form the end portions 24, 26 of the roll assembly mounted on the frame 12 as well as elements positioned between the end portions. The roll body structure 30 may further include a central core 32 which is substantially centrally located between the ends 22, 23 of the roll assembly, and may be positioned longitudinally inwardly of the end portions 24, 26 of the assembly 20. The central core 32 may have an exterior surface 34 which in preferred embodiments is substantially cylindrical in shape. The central core may have opposite core ends 36, 37, and each of the core ends may define a pocket 38 which generally extends into the central core from the respective core end and may extend along the central rotation axis 18 of the assembly 20. Each of the core ends may have an annular rib 39 spaced radially outward from the pocket 38 on the respective end 36, 37.

In some embodiments, the central core 32 may comprise a plurality of core portions 40, 42 which each may be elongated and positioned end to end between the core ends 36, 37. Each of the endmost core portions 40, 42 may have one of the pockets 38. The core portions may be separated by an annular groove 43 which is formed in the exterior surface 34 of the central core between the core portions.

The roll body structure 30 may also include a roll shaft 44 which extends inwardly from the ends 22, 23 of the roll assembly, and may extend outwardly from the central core 32 to the ends. In some embodiments, the roll shaft 44 may comprise a pair of stub shaft elements 46, 48 located at the opposite ends 22, 23 of the roll assembly, and each stub shaft element may form one of the end portions of the assembly 20. Each of the stub shaft elements may be partially positioned in one of the pockets 38 formed in the central core 32. Each of the stub shaft elements may have a substantially cylindrical shape suitable to be journaled in a bearing on the frame 12 to permit rotation of the roll assembly with respect to the frame.

The roll assembly 20 may also include a roll cover structure 50 which may be generally positioned about the central core and portions of the stub shaft elements. The roll cover structure 50 may have opposite ends including a first end 52 and a second end 53, and the position of the ends 52, 53 may generally correspond to the core ends 36, 37 on the center core of the roll assembly. The roll covers structure 50 may have a circumferential surface 54 which may be generally cylindrical in shape. Typically, teeth are located on the circumferential surface.

The roll cover structure 50 may include a roll cover 56 which may comprise a plurality of roll cover segments 60, 62. Each of the roll cover segments may have an exterior face 64 which forms a portion of the circumferential surface 54 of the structure 50. The exterior face 64 may be generally convex in shape, and the segments 60, 62 may also have an interior face 65 which may be generally convex in shape. Each of the roll cover segments 60, 62 may have opposite segment end edges 66, 67, and the end edges may be generally arcuate in shape. Each of the segment end edges 66, 67 may have an arcuate groove 68 formed therein. Each roll cover segment may also have opposite segment side edges 70, 71 which may be substantially linear and may be positioned adjacent to a segment side edge of an adjacent roll cover segment of the roll cover when the roll cover structure is assembled.

In illustrative embodiments, four of the cover segments are utilized to extend about the circumference of the roll assembly, and in further illustrative embodiments, two of the cover segments are positioned in a longitudinal relationship between the first 52 and second 53 ends of the roll cover structure. Other configurations of the segments may be utilized while the illustrative configuration is highly suitable.

The roll cover structure 50 may also include a cover retaining assembly 72 which is configured to retain the roll cover 56 on the central core 32 during usage of the roll assembly 20. Elements of the roll cover retaining assembly 72 may be positioned on the opposite ends of the roll cover segments 60, 62 of the cover 56, and may engage the opposite end edges 66, 67 of the segments to secure the segments to the central core 32.

The cover retaining assembly 72 may include a pair of cover end caps 74, 76 with each of the end caps being positioned at a respective one of the ends of the roll cover structure 50. Each of the cover end caps 74, 76 may be configured to secure the roll cover to the central core 32 of the roll body structure. Each of cover end caps 74, 76 may have a longitudinally inward face 78 oriented toward the segments and a longitudinally outward face 79 oriented away from the segments. Each of the cover end caps may incorporate a retaining feature 80 which is configured to engage an end edge of one or more cover segments to thereby retain the cover segments on the core 32. In some embodiments, the retaining feature 80 may comprise an annular ridge 82 which is configured to engage the arcuate groove 68 on one or more of the roll cover segments. The annular ridge 82 may be located on the inward face 79 of each of the respective cover end caps. Additionally, the cover end caps may engage the annular rib 39 on the respective core end 36, 37 which functions to hold the end caps in place with the segments.

In some embodiments, each of the end caps 74, 76 may comprise a plurality of arcuate members 84, 86 which are positioned in an annular configuration with each of the arcuate members having a portion of the annular ridge 82 formed thereon. The arcuate members 84, 86 may be positioned about one of the stub shaft elements 46 adjacent to the core ends 36, 37 and may form a continuous circular end cap.

The cover retaining assembly 72 may also include at least one retaining element 88 to retain the roll cover segments 60, 62 on the central core 32 and is positioned in opposition to one of the cover end caps 74, 76 such that the retaining element and an end cap holds one or more of the segments in position on the central core. The retaining element 88 may engage the segment end edges 66, 67 of two adjacent roll cover segments to support the segment end edges and the segments against outward radial movement with respect to the central core 32. A portion of the retaining element 88 may be positioned in an annular groove 43 of the core portion, and may be fastened to the core portion by a suitable fastener. The retaining element or elements 88 may include a pair of oppositely extending alignment tabs 90, 92 for removably positioning in the arcuate grooves 68 of the segment end edges of the adjacent roll cover segments of the roll cover.

Each of the rolls 14, 16 typically has a plurality of teeth 94 in order to produce grinding of material passing through the gap between the rolls. The teeth 94 are located on the circumferential surface 54 of the roll cover structure 50, and typically extend from the first end 52 to the second end 53 of the structure 50. Typically, but not necessarily, the teeth 94 may be substantially straight between the opposite ends 52, 53 and may be substantially continuous between the ends, but other configurations may be utilized.

In some embodiments, the plurality of corrugations or teeth 94 are integrally formed on the exterior face 64 of the roll cover segments 60, 62 such that replacement of the teeth requires replacement of the segments, and removal of the segments from the roll assembly removes at least a portion of the plurality of teeth from the roll assembly. In such embodiments, replacement of the teeth, or restoration of the roll to a suitable operating condition, may be accomplished by selective replacement of some or all of the roll cover segments of the roll cover.

In further embodiments, the plurality of teeth 94 may be incorporated into elements which are removably mounted on the roll cover 56 (such as on the roll cover segments 60, 62), or may be removably mounted on the central core 32. In an illustration of these embodiments, a plurality of mounting slots 96, 98 may be formed on the exterior face 64 of the cover segments 60, 62, and those slots may extend from the first end 52 toward the second end 53. The slots 96, 98 may extend from one segment end edge 66 toward the other segment end edge 67, and may be oriented substantially parallel to the segment side edges 70, 71. A plurality of tooth slats 100, 102 may be mounted on the roll cover segments with each of the tooth slats engaging at least one of the mounting slots, and the slats may be removably mounted on the slots. Each of the teeth slats may be elongated with opposite slat ends 104, 106, and may have an outer side 108 forming a portion of the circumferential surface 54 of the roll cover structure as well as having an inner side 110 generally facing the exterior face 64 of one or more roll cover segments on which the tooth slat is mounted. At least one ridge 112 may be formed on the outer side 108 of the tooth slat and may form the tooth of the tooth slat. A projection 114 may be provided on the tooth slat for engaging one of the mounting slots 96, 98. The projection may be located on the inner side 110 of the slat and may extend from one of the slat ends 104 toward the opposite slat end 106. The projection 114 and the mounting slot 96 may have complementary shapes, and most suitably a shape that resists outward radial movement of the tooth slat while permitting sliding movement of the projection 114 with respect to the mounting slot. Such a relationship may be provided by a dovetail configuration.

Each of the teeth 94 may have a ridge peak 120 which may extend along the longitudinal length of the tooth 94.

Each of the teeth 94 may have a pair of side surfaces 122, 124 which converge at the ridge peak 120. The side surfaces may be oriented at an angle with respect to each other, and suitable angles may range from approximately 3 degrees to approximately 66 degrees, although other angles may be utilized. The side surfaces 122, 124 may extend between the ridge peak and valleys 126 positioned between the two and adjacent teeth.

Another approach of the disclosure in dealing with wear on grinding rolls is to reduce the rate at which the teeth of the rolls wear to a form that is relatively ineffective for grinding. In some embodiments of the disclosure, each tooth of the plurality of teeth has a coating 130 applied to the tooth, as is illustratively shown in FIGS. 16 through 18. The coating 130 may be comprised of a material with relatively greater wear resistance than the base material forming the tooth 94 and typically the material forming the remainder of the roll. The material may be relatively harder than the base material of the tooth.

Illustratively, the coating 130 may be applied to the ridge peak 120 as well as portions of the first 122 and second 124 side surfaces of the tooth extending from the ridge peak down the tooth toward the valleys 126. In some embodiments, the coating 130 may extend through and across the surface of the valley 126 to form a substantially continuous coating from ridge peak to ridge peak, although some discontinuity at the base of the valley may be utilized.

The coating 130 may contain, for example, tungsten carbide to achieve a suitable hardness, although other materials may be employed as well, such as, for example, cobalt, nickel, platinum-groups and chromium. In some implementations, a suitable hardness may be a Vickers hardness in the range of approximately 500 HV to 2000HV, although other hardness levels may be suitable. Illustratively, the base material of the roll may be a white chilled cast iron. Illustratively, the base material of the roll may be a white chilled cast iron having, for example a Vickers hardness of approximately 649HV.

The coating 130 may be applied using any suitable approach. Some examples of suitable application techniques include a High Velocity Oxygen Fuel (HVOF) technique or a High Velocity Air Fuel (HVAF) technique, although other techniques may also be suitable. A suitable thickness of the coating may be in the range of approximately 0.0005 inches to approximately 0.015 inches, although other thicknesses may be employed.

Figure 13:
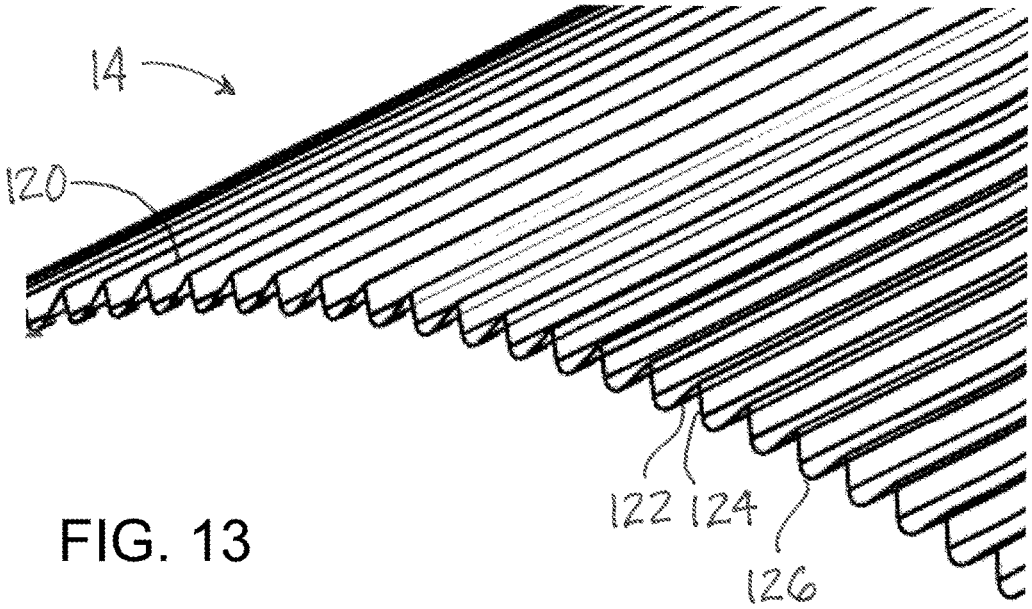
FIG. 13 is a schematic perspective view of a portion of a roll showing the teeth on the roll, according to an illustrative embodiment.
Figure 14:
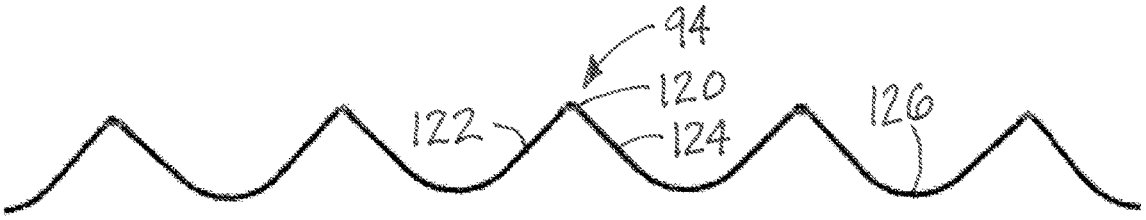
FIG. 14 is a schematic sectional view of a portion of a roll showing the teeth of the roll in a relatively unworn condition.
Figure 15:
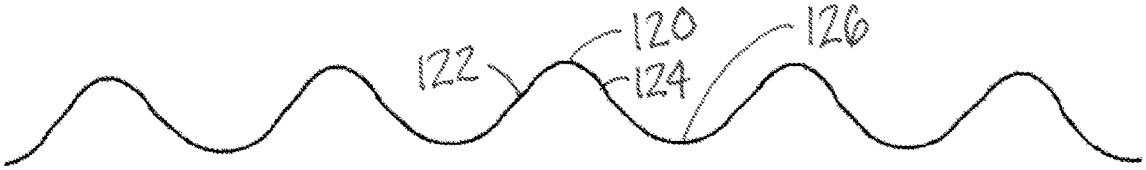
FIG. 15 is a schematic sectional view of a portion of a roll showing the teeth of the roll in a relatively worn condition characteristic of uncoated teeth.
Figure 16:
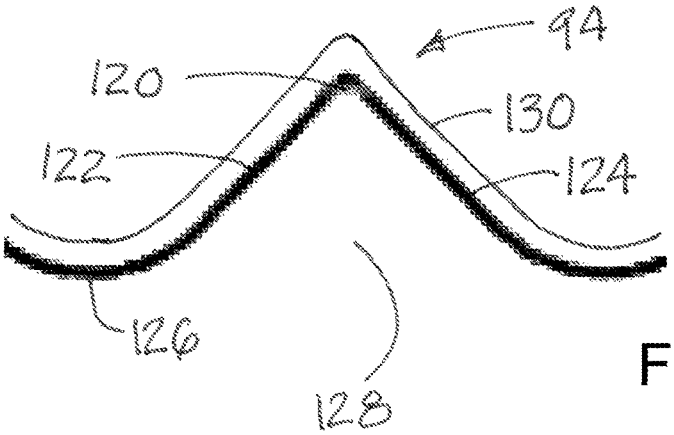
FIG. 16 is a schematic sectional view of a portion of a roll showing a tooth of the roll with a coating according to an illustrative embodiment.

In use, as the teeth of the roll are worn by the material being ground, the tip or ridge peak 120 of the tooth may experience wear at an exponential rate due to the relatively small surface area of the sharpened ridge peak having the greatest amount of exposure to the material being ground. FIGS. 13 and 14 show a cross section of a typical tooth (whether uncoated or coated). FIG. 15 shows an illustrative cross section of an uncoated tooth 94 after a period of time, and the tooth exhibits wear that typically creates a rounded upper region as the material forming the surface of the tooth wears away relatively uniformly after the initial fast wear of the ridge peak. Notably, the surface of the worn uncoated tooth lacks any sharpness or sharp edges or portions of the profile which are linear to produce a sharp feature, as most or all portions of the profile are curved to produce a substantially undulating profile reminiscent of a sine wave. As a result, each tooth and the plurality of teeth in the aggregate may be less effective at grinding the material passing through the gap between the rolls. Teeth with the rounded worn profile typically struggle to cut the material being ground, and often "mash" or "flake" or otherwise compress at least some of the material resulting in less uniformity of the material outputted by the grinding apparatus.

Figure 17:
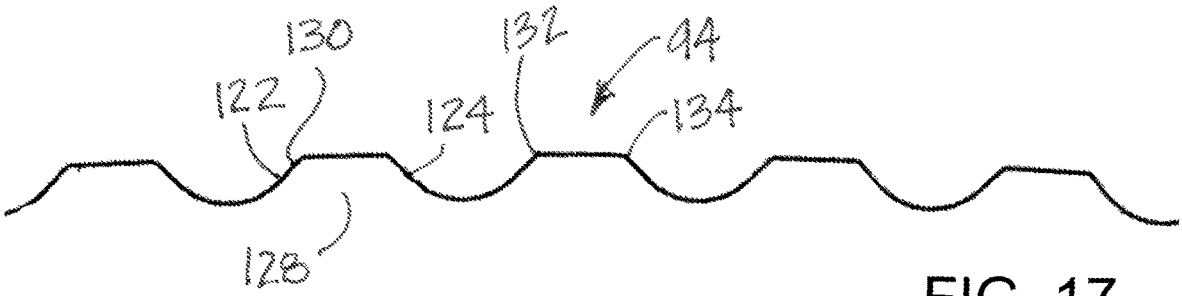
FIG. 17 is a schematic sectional view of a portion of a roll showing the teeth of the roll in a relatively worn condition characteristic of teeth with a coating according to an embodiment of the disclosure.
Figure 18:
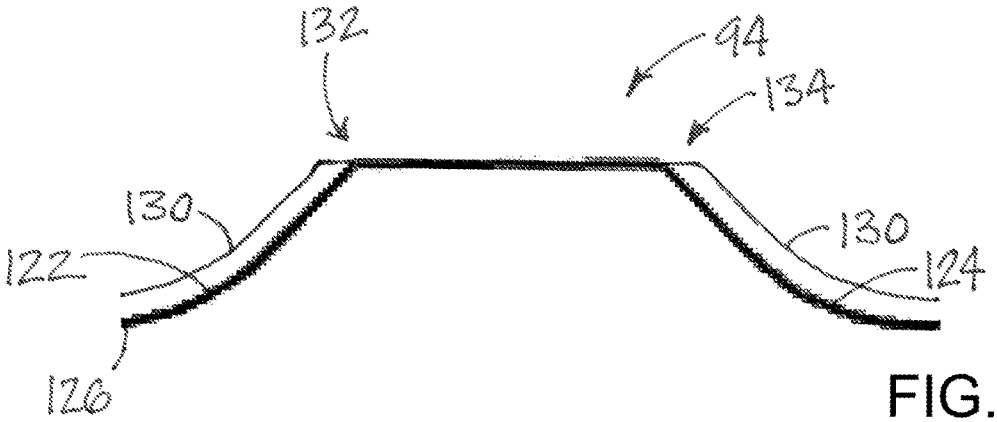
FIG. 18 is a schematic sectional view of a portion of a roll showing a coated tooth of the roll in a relatively worn condition.

Application of the high wear resistance material to the surfaces of the tooth 94 to create the coating 130 produces a layer of the relatively harder material of the coating on top of the relatively softer base material 128 of the roll body. As the harder material of the coating 130 is worn away from the ridge peak 120 during use of the roll for grinding or milling of material, the relatively softer base material 128 of the roll is exposed between areas of the tooth surface still bearing the coating. The base material of the tooth wears at a faster rate than the relatively harder coating 130 remaining on the tooth. As a result of the faster wear of the base material 128 due to relatively less wear resistance, and the slower wear of the material of the coating 130 due to relatively greater wear resistance, the profile of the worn coated tooth may not progress to the relatively rounded profile of the worn uncoated tooth. Instead, one or more relatively sharper edges 132, 134 may be created on the worn tooth, such as shown in FIGS. 17 and 18, at the point of transition between the coated and uncoated surfaces of the base material. In other words, the locations on a tooth where areas of the tooth remains meet areas where wear on the roll has taken the coating off and exposed the base material, relatively sharp transitions may occur which would otherwise be a smoother curved transition on a completely uncoated tooth.

Illustratively, the surfaces of the worn coated tooth may form a relatively trapezoidal-shaped profile in the cross section, which contrasts with the rounded undulating-shaped profile of the cross section of the worn uncoated tooth. The edges 132, 134 permit the tooth to more effectively pull the material through the gap between the rolls as well as cut the material as it passes through the gap even as the tooth begins to exhibit significant wear, and thus is more effective for a longer period of time before the tooth no longer has a sufficient edge and thus tends to flake the material being ground.

Figure 19:
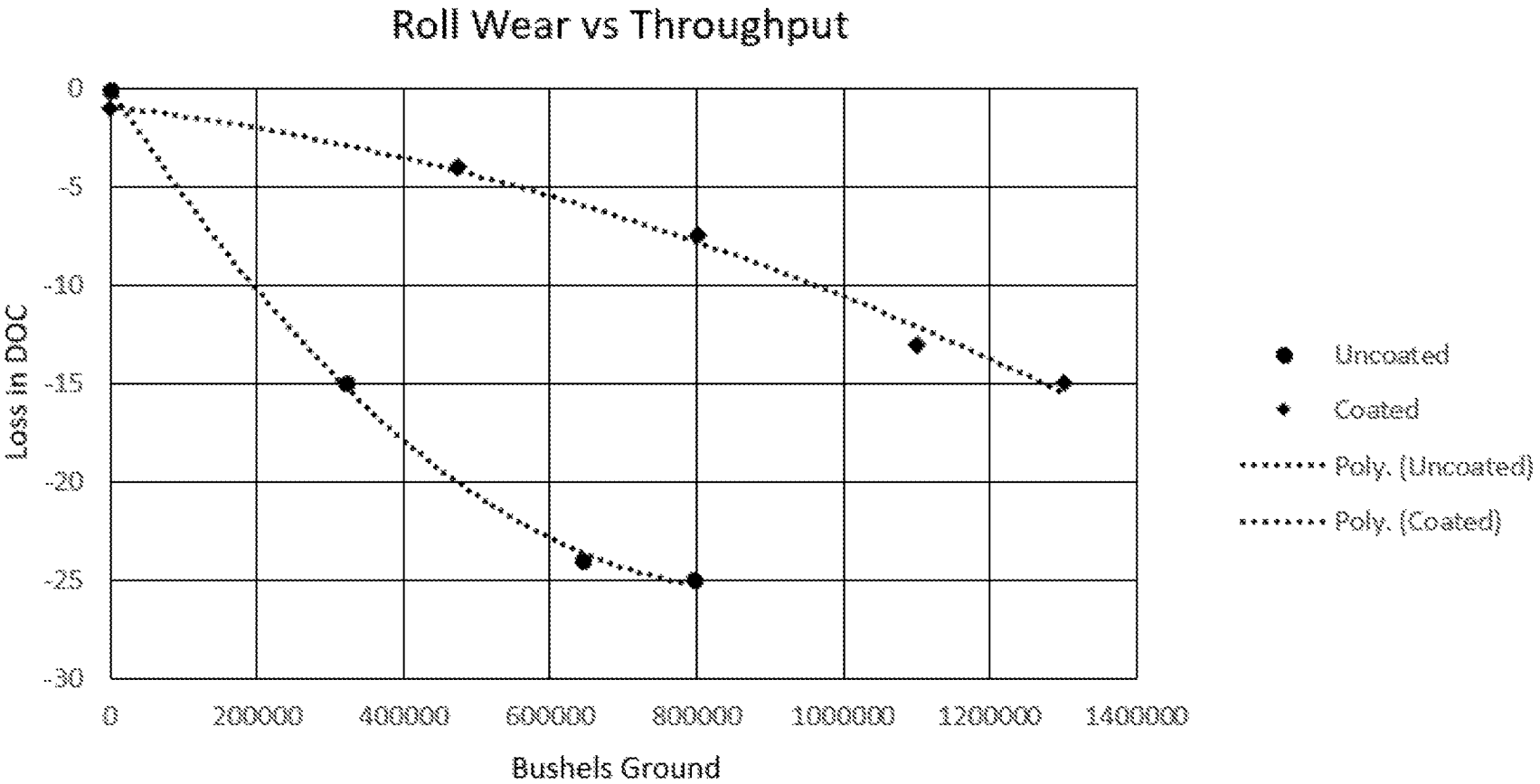
FIG. 19 is a schematic graph showing a graphical representation of wear experienced by a coated tooth and an uncoated tooth.

FIG. 19 shows a graph of the value of the depth of cut (DOC), or distance from the ridge peak 120 of the tooth to bottom of the valley 126, with respect to the value of the quantity of bushels of material ground by the apparatus on which the roll is mounted. Slash-marked data point dots on the graph represent the relationship between the DOC and the quantity of bushels passing through the apparatus for rolls having teeth which do not have the coating 130, and X-marked data point dots on the graph represent the relationship between the DOC and the bushel quantity through the apparatus for rolls having teeth with the coating 130. The results represented on the graph of FIG. 19 demonstrate the ability of the coating to greatly extend the life of the roll by reducing the rate at which the DOC of the teeth is reduced as compared to rolls having teeth which are uncoated.

Yet another approach of the disclosure for dealing with wear on a grinding roll is to form a portion of the surface of each tooth with a relatively harder material while other portions of the surface of the tooth are formed by a relatively softer base material, such as the material forming the major portion of the roll. In some embodiments, a portion of the tooth may be formed by a relatively harder material that is more substantial than a layer or coating.

Figure 20:
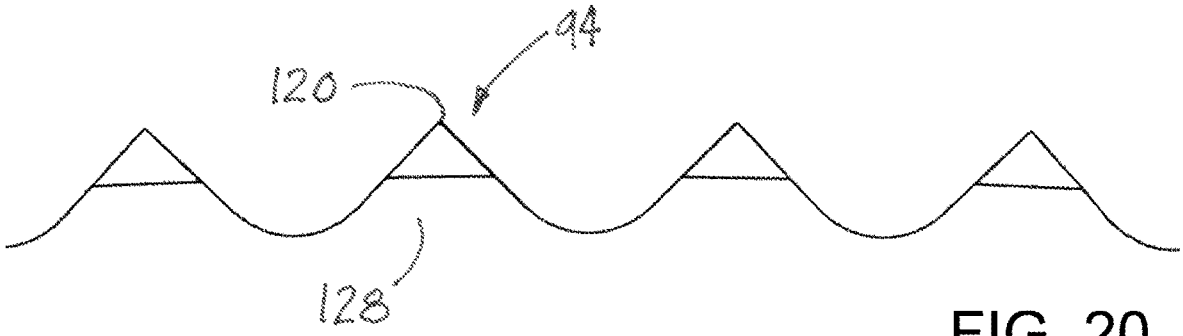
FIG. 20 is a schematic sectional view of a portion of a roll showing a plurality of teeth having upper cap portions and lower base portions, according to an illustrative embodiment.
Figure 21:
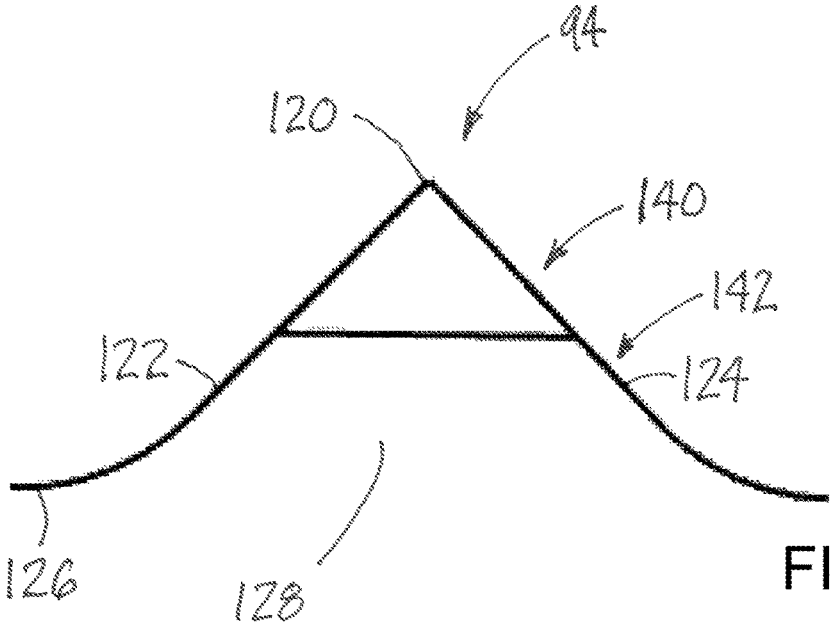
FIG. 21 is a schematic sectional view of a portion of a roll showing a tooth having an upper cap portion and a lower base portions, according to an illustrative embodiment.

The substantial portion of the tooth formed by the harder material may have a prismatic shape, and in some embodiments may form substantially an entirety of an upper cap portion 140 of the tooth 94 which is positioned on a lower base portion 142 of the tooth, such as is shown in FIGS. 20 and 21. The upper cap portion 140 may be formed of the relatively harder material, such as, for example, carbide-containing materials, cobalt-containing materials, nickel-containing materials, platinum-group materials, and chromium-containing materials, while the lower base portion 142 may be formed of the relatively softer material, such as cast-iron.

The upper cap portion 140 may be formed on the lower base portion 142 in any suitable manner, and one particularly suitable technique for forming the upper cap portion is through the use of additive manufacturing or extrusion techniques which add or deposit material on a base, such as the lower base portion, in a succession of substantially repetitive motions, gradually building up the material through repeated passes depositing material representing only a fraction of the material needed for the finished upper cap portion directly onto the lower base portion, or onto a layer formed by material deposited by an earlier pass which ultimately rests upon the lower base portion. Optionally, a metal extrusion die shaped to replicate the tooth profile may be utilized to trace the tooth profile on the roll surface to add material to the void areas of the roll surface from which material has been worn off during use of the roll for grinding material, This technique may permit the roll diameter to remain consistent from roll change to roll change and may avoid the need to discard the roll core after approximately 10 to 12 re-sharpenings.

The prismatic upper cap portion 140 may have a substantially triangular cross sectional shape, while the lower base portion 142 may have a substantially trapezoidal shape. The proportion of the height of the tooth that is formed by the upper cap portion and the lower base portion may be varied. Forming a substantial section of the tooth with the upper cap portion, and the relatively harder material thereof, produces a greater portion of the tooth faces formed of the harder material for greater wear resistance over a greater portion of the surface of the tooth. Illustratively, in some embodiments the upper cap portion 140 may extend radially inwardly from the ridge peak a distance that may range from approximately 0.01 inches to approximately 0.4 inches, although other distances, or heights of the upper cap portion, may be utilized. By minimizing the height of the upper cap portion to only as much of the height of the tooth that is likely to wear, the amount of the material deposited on the roll to produce the upper cap portion may be beneficially minimized to advantageously reduce the amount of the relatively expensive hard material utilized.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A grinding apparatus comprising:

a frame; and a pair of rolls, each roll of the pair of rolls having a circumferential surface and being mounted on the frame to define a gap between the circumferential surfaces of the pair of rolls, each roll of the pair of rolls being rotatable about a central rotation axis with respect to the frame, a plurality of teeth being located on the circumferential surface of each roll of the plurality of rolls, the teeth on each roll being elongated in a direction parallel to the central rotation axis of the roll;

wherein at least one roll of the pair of rolls comprises:

a roll assembly for rotating about the central rotation axis of the at least one roll, the roll assembly being elongated with opposite ends and end portions located adjacent to the opposite ends, the end portions of the roll assembly being rotatably mounted on the frame, the roll assembly comprising:

a roll body structure forming the end portions of the roll assembly; and a roll cover structure forming the circumferential surface of the at least one roll;

wherein the roll cover structure is at least partially removably mounted on the roll body structure to permit replacement of at least a portion of the circumferential surface without requiring removal of the roll body structure of the roll assembly from the frame.

2. The apparatus of claim 1 wherein the teeth on each roll of the pair of rolls extends continuously from a first end of the roll assembly to a second end of the roll assembly.

3. The apparatus of claim 1 wherein the roll cover structure comprises a roll cover, the roll cover including a plurality of roll cover segments forming the circumferential surface of the roll cover structure, each of the roll cover segments having a portion of the circumferential surface thereon and forming a portion of the plurality of teeth corresponding to the portion of the circumferential surface, the roll cover segments being individually removable from and replaceable on the roll body structure.

4. The apparatus of claim 3 wherein each of the roll cover segments has a convex exterior face forming a portion of the circumferential surface with a portion of the plurality of teeth, each of the roll cover segments having a concave interior face.

5. The apparatus of claim 3 wherein the roll cover structure further comprises a roll cover retaining assembly configured to retain the roll cover structure on the roll body structure, the roll cover retaining assembly being positioned on opposite ends of the roll cover structure.

6. The apparatus of claim 5 wherein each of the roll cover segments has at least one segment end edge with a groove, and wherein the roll cover assembly engages the groove on the at least one segment end edge of a said roll cover segment.

7. The apparatus of claim 6 wherein the roll cover retaining assembly comprises a pair of cover end caps each positioned at a respective end of the roll cover structure, each of the cover end caps being configured to secure the roll cover to a central core of the roll body structure.

8. The apparatus of claim 1 wherein the plurality of teeth are integrally formed on the roll cover structure.

9. The apparatus of claim 1 wherein the plurality of teeth are removably mounted on elements of at least one roll of the pair of rolls.

10. The apparatus of claim 9 wherein the circumferential surface of the at least one roll includes a plurality of mounting slots; and a plurality of tooth slats each being removably mounted on a respective one of the mounting slots, each of the tooth slats having an outer side forming a portion of the circumferential surface of the roll, at least one ridge being formed on the outer side of the tooth slat to form the tooth of the tooth slat.

11. The apparatus of claim 10 wherein the at least one roll comprises a roll assembly including a roll cover structure with a plurality of roll cover segments, a portion of the plurality of mounting slots being formed in an exterior face of the roll cover segment to permit removable mounting of the tooth slat on the roll cover segment.

12. The apparatus of claim 10 wherein each of the tooth slats has an inner side facing inwardly toward a central rotation axis of the at least one roll, each of the tooth slats having a projection formed on the inner side of the tooth slat for engaging one of the mounting slots.

13. The apparatus of claim 12 wherein the projection on a said tooth slat is configured to slide into a respective said mounting slot.

14. The apparatus of claim 12 wherein each of the teeth slats is elongated between opposite slat ends, the projection extending longitudinally between the opposite slat ends.

15. The apparatus of claim 1 wherein the roll body structure includes:

a central core substantially centrally located between the ends and inward of the end portions of the roll assembly, the central core having opposite core ends, the central core being substantially hollow.

16. The apparatus of claim 15 wherein each of the core ends define a pocket extending into the central core from the core end; and wherein the roll body structure further includes a roll shaft extending inwardly from the ends of the roll assembly outwardly from the central core to the ends of the roll assembly, the roll shaft comprising a pair of stub shaft elements at the opposite ends of the roll assembly, each of the stub shaft elements forming one of the end portions of the roll assembly, each of the stub shaft elements extending at least partially positioned in one of the pockets of the central core.

17. The apparatus of claim 16 wherein the pair of stub shaft elements are separated by a gap therebetween.

18. The apparatus of claim 1 wherein the teeth on a said roll of the pair of rolls extend parallel to the rotation axis of the roll.

* * * * *